US011059663B2

(12) United States Patent
Morgan

(10) Patent No.: US 11,059,663 B2
(45) Date of Patent: Jul. 13, 2021

(54) SHIPPING CARGO CONTAINER WITH A REMOVABLE SHELL THAT EXPOSES CARGO FOR SAFE AND EASY LOADING AND UNLOADING OF THE CARGO

(71) Applicant: Derrick Morgan, Waynesboro, MS (US)

(72) Inventor: Derrick Morgan, Waynesboro, MS (US)

( * ) Notice: Subject to any disclaimer, the term of this patent is extended or adjusted under 35 U.S.C. 154(b) by 0 days.

(21) Appl. No.: 16/425,671

(22) Filed: May 29, 2019

(65) Prior Publication Data

US 2020/0377293 A1 Dec. 3, 2020

(51) Int. Cl.
*B65D 88/00* (2006.01)
*B65D 88/12* (2006.01)
*B65D 90/12* (2006.01)

(52) U.S. Cl.
CPC ..... *B65D 88/129* (2013.01); *B65D 90/12* (2013.01)

(58) Field of Classification Search
CPC ..... B65D 88/129; B65D 90/12
USPC ..... 220/1.5, 4.28, 8; 206/386; 108/55.1, 108/55.5
See application file for complete search history.

(56) References Cited

U.S. PATENT DOCUMENTS

| | | | | |
|---|---|---|---|---|
| 2,408,731 | A | 10/1946 | Burger | |
| 3,040,925 | A | 6/1962 | Mills | |
| 3,423,101 | A | 1/1969 | Boeye | |
| 3,459,326 | A | 8/1969 | Betjemann | |
| 3,480,196 | A | 11/1969 | Simas | |
| 3,801,177 | A | 4/1974 | Fylling et al. | |
| 3,904,064 | A | 9/1975 | Looker | |
| 3,907,147 | A | 9/1975 | Goobeck | |
| 3,981,410 | A | 9/1976 | Schurch | |
| 4,013,168 | A | 3/1977 | Bamburg et al. | |
| 4,050,604 | A | 9/1977 | Flanders | |
| 4,151,925 | A | 5/1979 | Glassmeyer | |
| 4,214,669 | A | 7/1980 | McQuiston | |
| 5,111,950 | A * | 5/1992 | Wylenzek | B65D 88/129 108/55.1 |
| 5,918,744 | A | 7/1999 | Bringard et al. | |
| 6,112,929 | A | 9/2000 | Ota | |
| 6,227,397 | B1 | 5/2001 | Kim | |
| 2009/0159592 | A1 | 6/2009 | Vitalis et al. | |
| 2010/0135742 | A1 | 6/2010 | Sain | |
| 2010/0191615 | A1 | 7/2010 | Thomas | |
| 2011/0073595 | A1 | 3/2011 | Crane | |
| 2014/0246425 | A1 * | 9/2014 | Janin | B65D 88/005 220/1.5 |
| 2016/0137404 | A1 | 5/2016 | Steiner | |

FOREIGN PATENT DOCUMENTS

| | | | |
|---|---|---|---|
| DE | 1804162 | A1 | 9/1970 |
| DE | 4435449 | A1 | 4/1998 |
| EP | 1279621 | A1 | 1/2003 |
| FR | 2850090 | B1 | 9/2005 |
| GB | 2329378 | A1 | 3/1999 |

* cited by examiner

*Primary Examiner* — James N Smalley
*Assistant Examiner* — Elizabeth J Volz
(74) *Attorney, Agent, or Firm* — Buche & Associates, P.C.; John K. Buche; Bryce A. Johnson

(57) ABSTRACT

A improved shipping container and related methods are embodied by a removable shell that exposes cargo for safe and easy loading and unloading of the cargo.

6 Claims, 11 Drawing Sheets

SHIPPING CARGO CONTAINER WITH A REMOVABLE SHELL THAT EXPOSES CARGO FOR SAFE AND EASY LOADING AND UNLOADING OF THE CARGO

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of shipping containers and related methods of loading and shipping heavy and delicate cargo.

Background of the Invention

A shipping container is more or less a large, heavy-duty box for storing cargo during transit from one location to another. Typically, it is difficult to load heavy and delicate items into a shipping container. Sometimes, the difficulty is caused by the need for persons and machinery for loading or unloading a shipping container to enter the container wherein they are exposed to pinch/crush point hazards. Even with due care, persons and machinery are often injured during movement of objects into and out of containers. Also, during hot months, entering the shipping container for loading or unloading purposes can be too hot, humid or suffocating for workers. And, the shipping container must be loaded back-first and unloaded front-first making load-planning a priority.

In view of the foregoing, the need for improved shipping containers and related methodologies is apparent.

LISTING OF PRIOR ART

U.S. Pat. No. 3,459,326 to Betjemann (1969) discloses a shipping container with removable side rails.

US Pub. Pat. App. 2011/0073595 to Crane (2011) discloses a collapsible freight container for an easy of loading and unloading with support yokes on the ends of the freight container.

U.S. Pat. No. 6,112,929 to Ota (2000) discloses a cargo container with an upper portion that may be lowered onto the lower portion. The corner posts allow the upper portion to reside on the lower portion and connecters may hold the walls of the upper portion securely to the lower portion.

US Pub. Pat. App. 2009/0159592 to Vitallis et al. (2009) discloses a cargo container with a removable roof.

US Pub. Pat. App. 2016/0137404 to Steiner (2016) discloses a shipping container with a top-access roof cover that is retractable.

U.S. Pat. No. 4,151,925 to Glassmeyer (1979) discloses a flatrack container with corner posts on the platform.

U.S. Pat. No. 3,981,410 to Schurch (1976) discloses a collapsible and nestable container with corner posts that have hinged sidewalls that may be swung open.

U.S. Pat. No. 6,227,397 to Kim (2001) discloses a variable height container wherein a mobile post is placed between fixed corner posts.

U.S. Pat. No. 3,480,196 to de Simas (1969 discloses a collapsible cargo container with separate interlocking side walls.

EP1279621 to Clive-Smith et al. (2002) discloses a cargo container with a removable roof and hinged side gates.

GB2329378 to Lam (1997) discloses a collapsible transport platform with side walls that can swing open and collapse.

U.S. Pat. No. 4,050,604 to Flanders (1977) discloses a container system with a floor, bracing support, sidewall, and lid members, which are interlockingly joined on to the other.

U.S. Pat. No. 5,918,744 to Bringard et al. (1999) discloses shipping containers with notches on the bottom for receiving forklifts.

US Pub. Pat. App. No. 2010/0191615 to Thomas discloses slots for forklifts and lifting components for cranes.

U.S. Pat. No. 3,801,177 to Fylling et al. (1974) discloses a shipping container with a drip pan.

SUMMARY OF THE INVENTION

An objective of this specification is to disclose a new shipping container that optimizes as well as creates a safer and efficient way to load and unload cargo. In one embodiment, the disclosed shipping container creates a safer work environment for personnel involved in loading or unloading of shipping containers via a reduction in pinch/crush points and potential line of fire hazards presented to the personnel while inside the container. In another embodiment, the disclosed shipping container creates a safer cargo environment via a reduction in the potential chance of dropping cargo or other objects.

Another objective of the specification is to disclose a shipping container with a design that reduces the chance of damaging rigging and side loading shackles due to moving equipment in or out of permanently enclosed containers. Suitably, it is another objective to provide an apparatus that reduces the chance of damaging delicate equipment while dragging from enclosed container and enhances financial discipline. Finally, it is an objective to describe a shipping container with dual uses. In one use the container may be converted from a shipping container to an open top CCU (cargo caring unit) to move cargo around on deck aboard ships and on land. In another embodiment, the CCU may be provided with built on loading ramps on all four sides for dolly access if needed.

In a preferred embodiment, the shipping container comprises a shell and a base wherein: the shell is defined by a door, a roof, two side walls, a back wall and at least one rail track; the base is defined by a floor, four walls, and a rail; the shell can be coupled to the base by associating the rail of the base with the rail track of the shell.

In a preferred mode of use, the shell of the shipping container may be removed, one of the four walls placed in a lowered configuration to form a ramp, cargo delivered to the floor of the base, raising the lowered wall to an upright configuration, installing the shell on the base, and lifting the shipping container for transport.

In one embodiment, after the shell is removed the walls may be lowered to define cargo ramps on all sides for easy access with dolly or crane, or one can leave cargo ramps up and in place and use skid part of container to transport cargo to new location with crane or forklift.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components are referenced by the numerals listed below:

shipping container 1000
shell 1100
door 1110
left side wall 1120
right side wall 1130
rear wall 1140
rail track 1150
roof 1160
lock 1199
base 1200
front wall 1210
left side wall 1220
right side wall 1230
rear wall 1240
rail 1250
locking mechanism 1251
locking mechanism 1252
chamfer 1253
floor 1260
drip pan 1261
fork lift slot 1262
lock 1299
bridle 2000

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFFERED EMBODIMENTS

Disclosed is a shipping cargo container with a removable shell that exposes cargo for safe and easy loading and unloading of the cargo. The container suitably includes slings that attach to the frame of the unit for easy lifting of the container by a crane. The unit may also feature slots for a forklift so that a forklift can be used to lift the container. The unit may also feature a built-in pollution pan that retain spills in the pan during transport. Moreover, the removable shell may be secured in place during transportation and the container will feature a water tight door design. The more specific aspects of the disclosed shipping container are described with reference to the figures.

Figure 1:
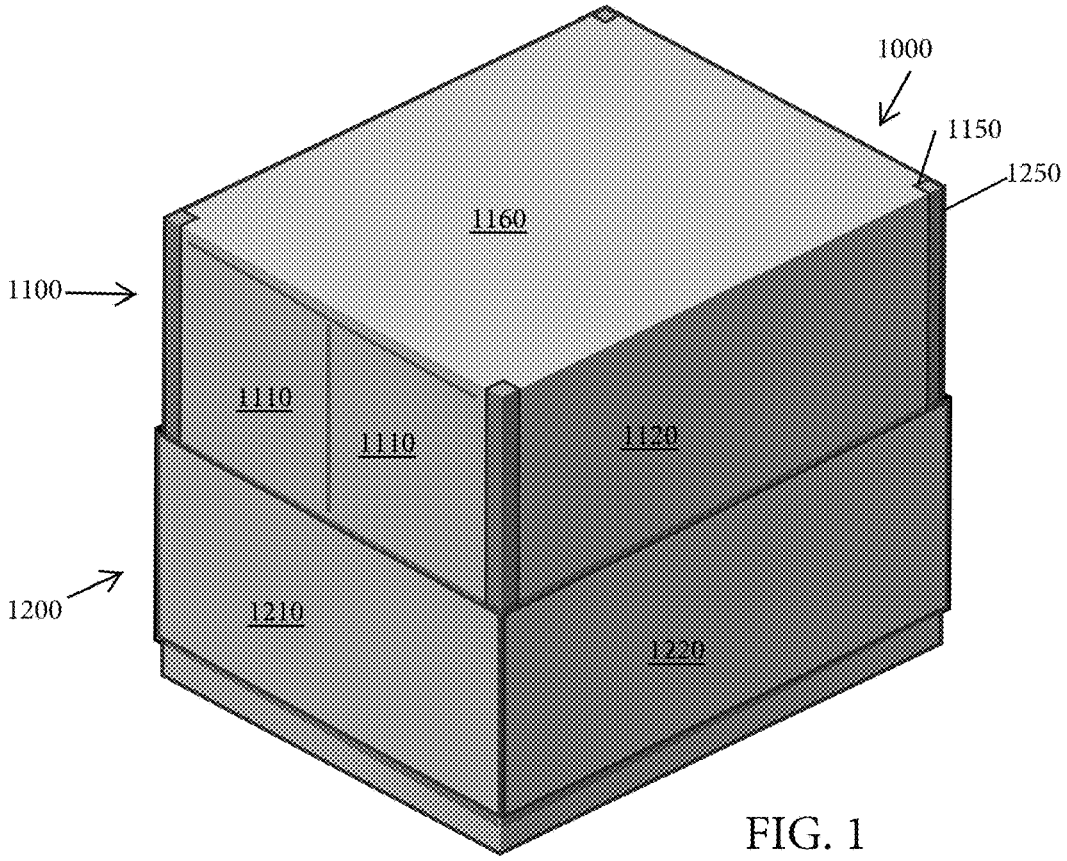
FIG. 1 is a perspective view of a shipping container 1000.
Figure 2:
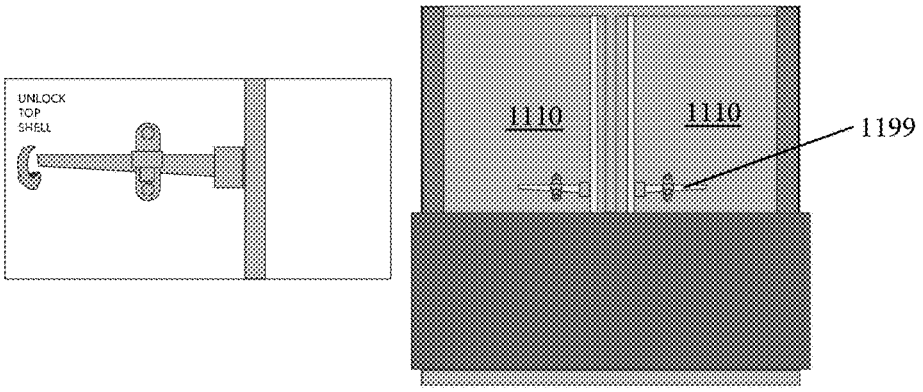
FIG. 2 is a front view of the shipping container 1000.
Figure 3:
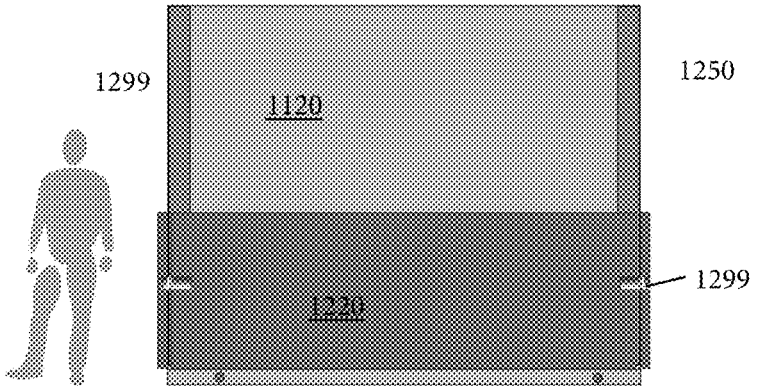
FIG. 3 is a side view of the shipping container.

FIG. 1 is a perspective view of a shipping container 1000. FIG. 2 is a front view of the shipping container 1000. FIG. 3 is a side view of the shipping container 1000. As shown, the container 1000 defines a box that has the dimensions of a standard shipping container, which dimensions are known to those of skill in the art. As can be appreciated, standard shipping container sizes are well known.

Still referring to FIGS. 1 through 3 the preferred embodiment of the shipping container 1000 is defined by a base 1200 and a shell 1100. As shown, the shell has a door 1110, a left wall 1120, a right wall 1130, a rear wall 1140, a roof 1160 and four rail tracks 1150. As shown, the base 1200 is defined by four walls 1210, 1220, 1230, and 1240 with a floor 1260 that has four upright rails. Suitably, the shell 1100 may be nested in the base 1200 by (as discussed in further detail below) associating the rails 1250 with the rail tracks 1150. Suitably the door 1110 of the shell 1100 may feature a lock 1199 and the walls 1210, 1220, 1230, and 1240 may each feature a lock 1299 that secure the walls 1210, 1220, 1230, and 1240 to the rails 1250.

Figure 4:
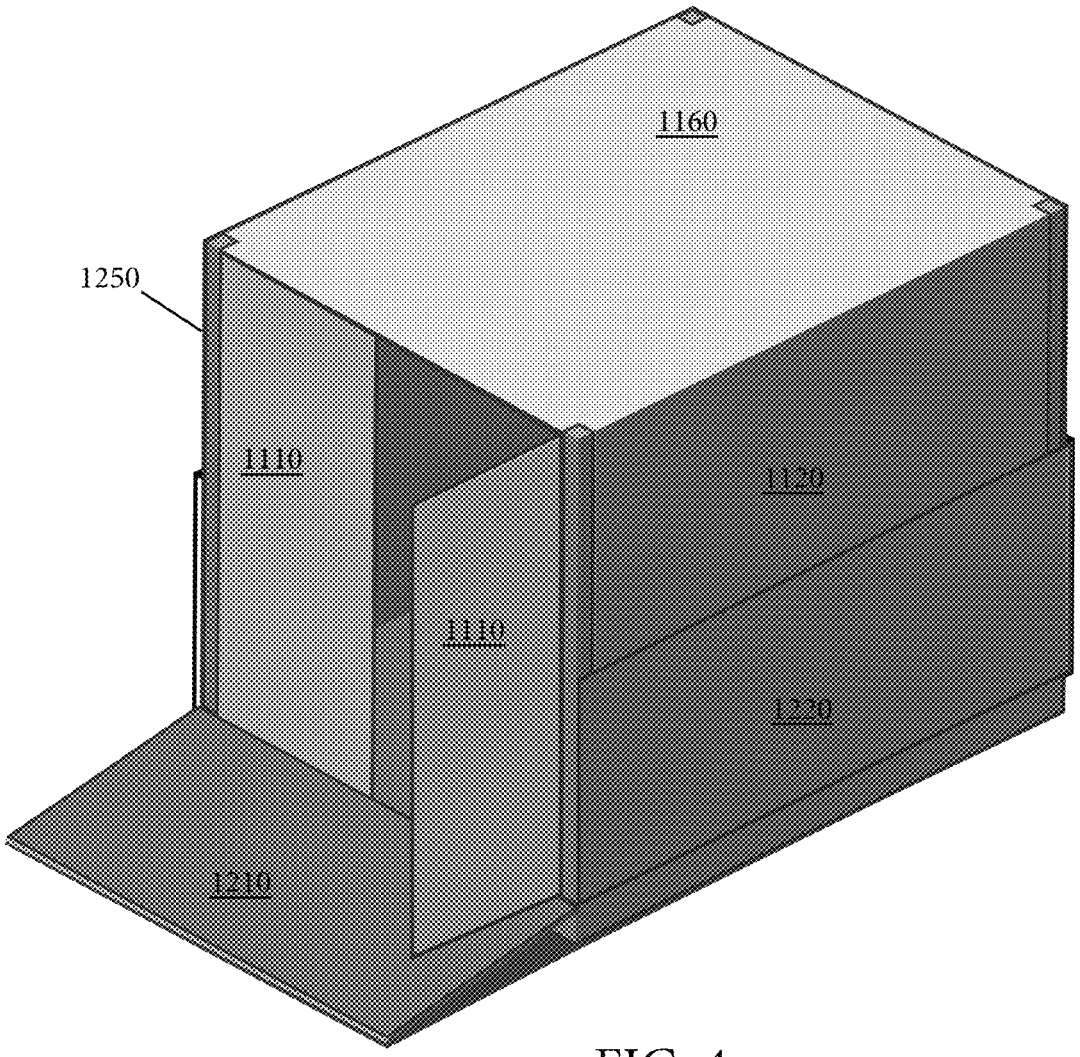
FIG. 4 is an environmental view of the shipping container 1000 wherein the front wall 1210 of the shipping container's 1000 base 1200 is lowered while the door 1110 of the shipping container's 1000 shell 1100 is in an open configuration.

FIG. 4 is an environmental view of the shipping container 1000 wherein the front wall 1210 of the shipping container's 1000 base 1200 is lowered while the door 1110 of the shipping container's 1000 shell 1100 is in an open configuration. As shown, the front wall 1210 may be lowered to form a ramp up to the floor 1260 and the door 1110 of the shell 1100 may be opened. When the shipping container 1000 is configured as shown in FIG. 4, the inside of the shipping container may be accessed in the typical manner.

Figure 5:
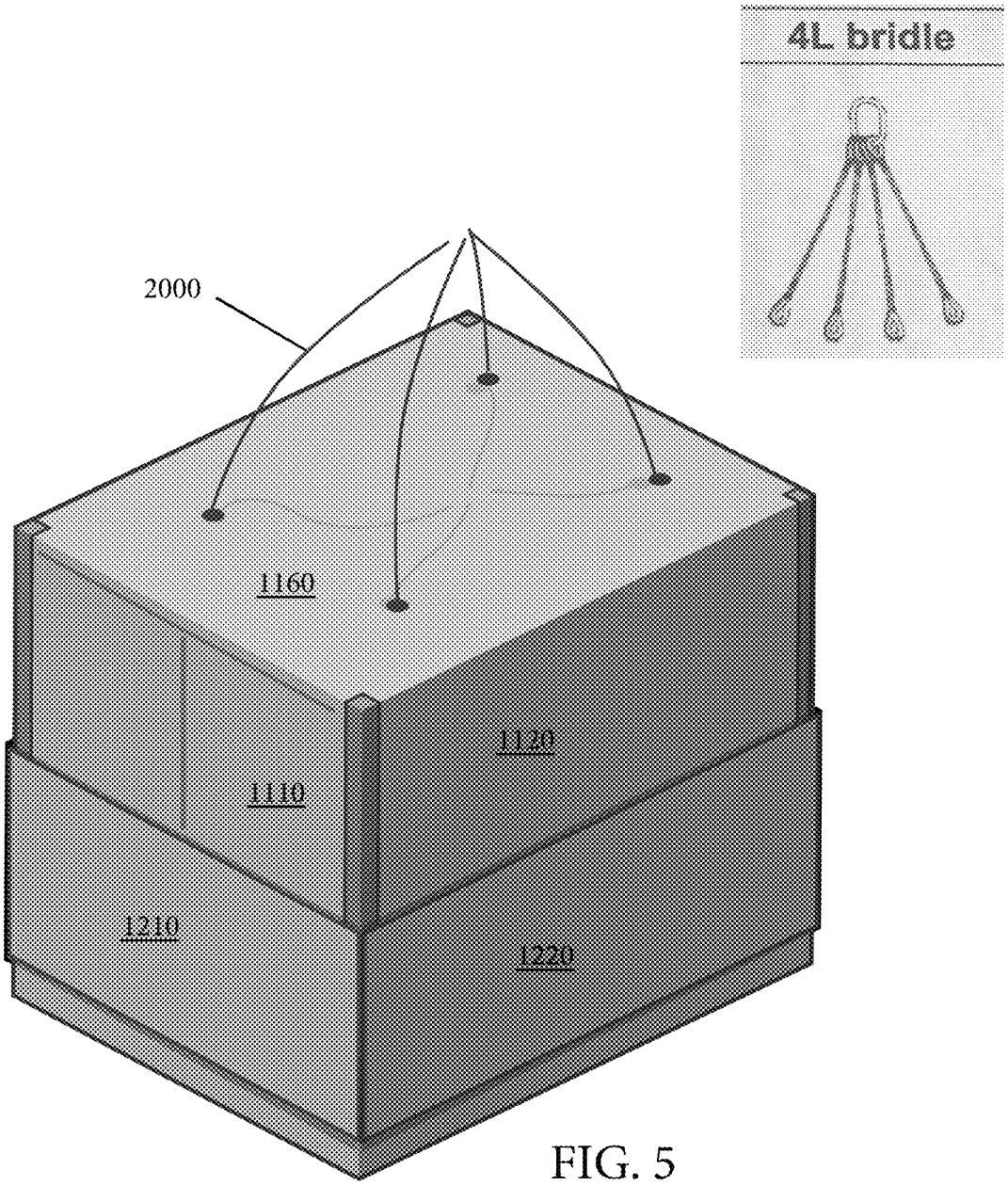
FIG. 5 is another environmental view of the shipping container 1000 wherein a bridle 2000 has been provided to the roof 1160 of the shipping container's 1000 shell 1100.

FIG. 5 is another environmental view of the shipping container 1000 wherein a bridle 2000 has been provided to the roof 1160 of the shipping container's 1000 shell 1100. As shown, the bridle 2000 may comprise wire slings attached to pad eyes set into the roof 1160 of the shell 100. In one embodiment, the bridle 200 has 4-part shackles. The shell 1100 could also be equipped with forklift slots on top for removal of the shell from the base if a crane or other like machinery is not available.

Figure 6:
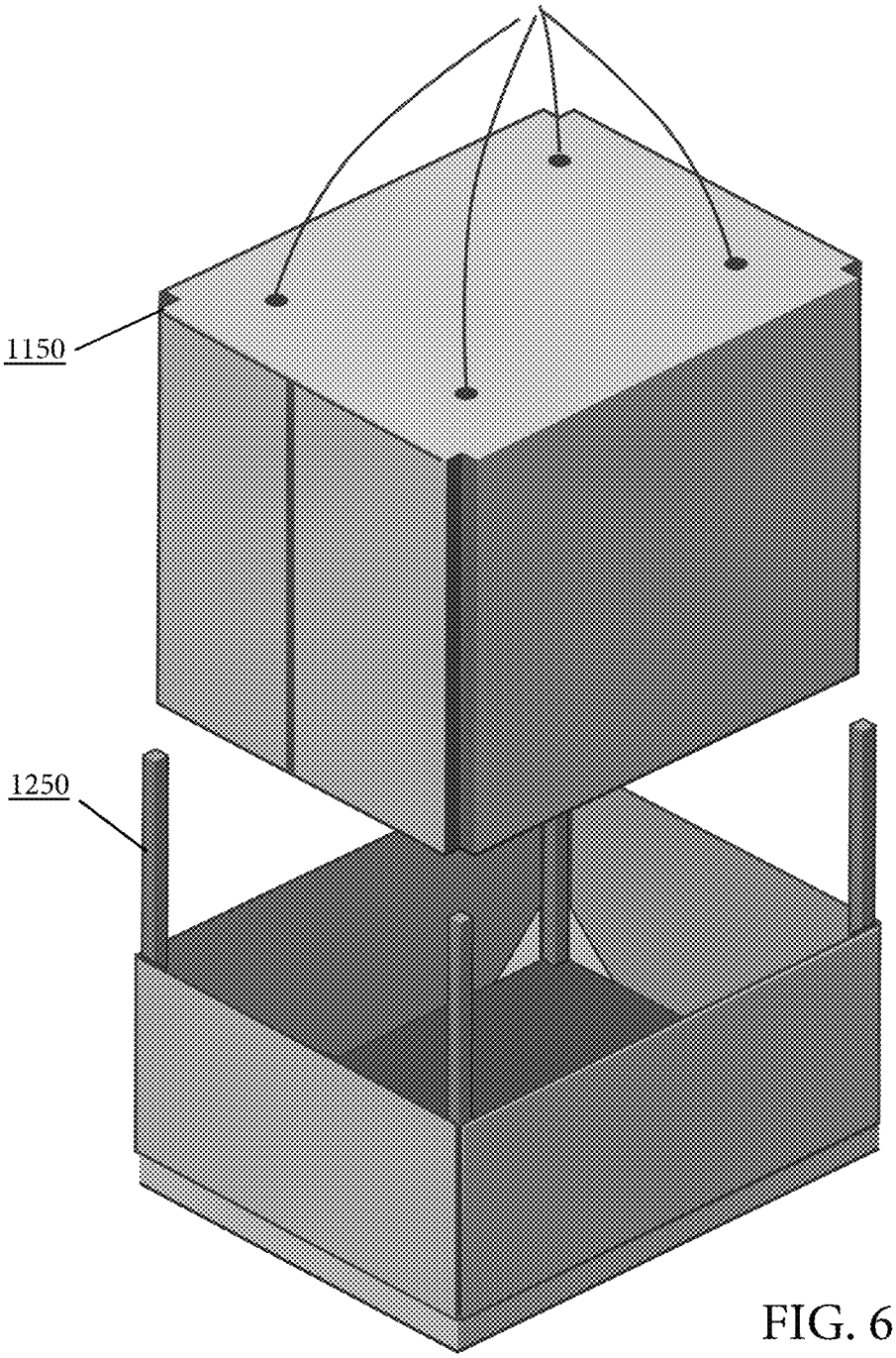
FIG. 6 is yet another environmental view of the shipping container 1000 wherein the bridle 2000 has been used to separate the shell 1100 from the base 1200.

FIG. 6 is yet another environmental view of the shipping container 1000 wherein the bridle 2000 has been used to separate the shell 1100 from the base 1200. As shown, the nested shell 1100 may be pulled upward so that the rails 1250 are removed from the rail tracks 1150.

Figure 7:
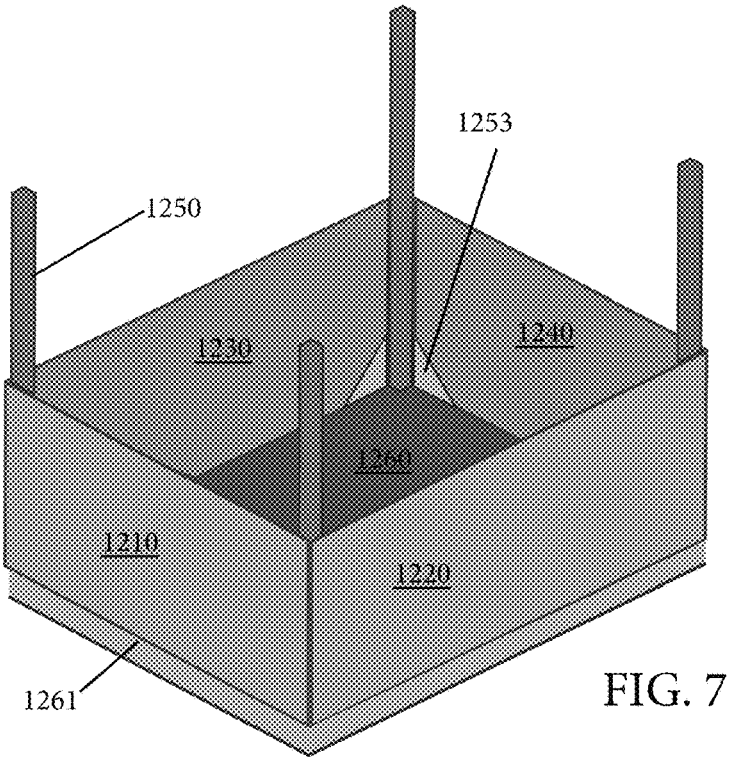
FIG. 7 is a perspective view of the base 1200.
Figure 8:
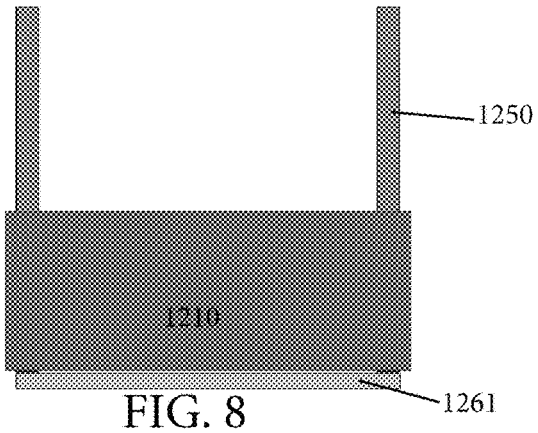
FIG. 8 is a front view of the base 1200.
Figure 9:
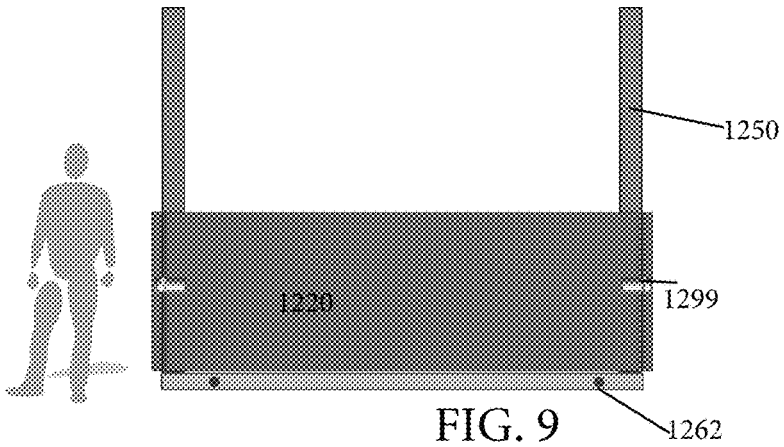
FIG. 9 is a side view of the base 1200.

FIG. 7 is a perspective view of the base 1200. FIG. 8 is a front view of the base 1200. FIG. 9 is a side view of the base 1200. As shown, the base may include a drip pan 1261 for catching drippings of the cargo. The rails of the base may be supported by chamfers 1253.

Figure 10:
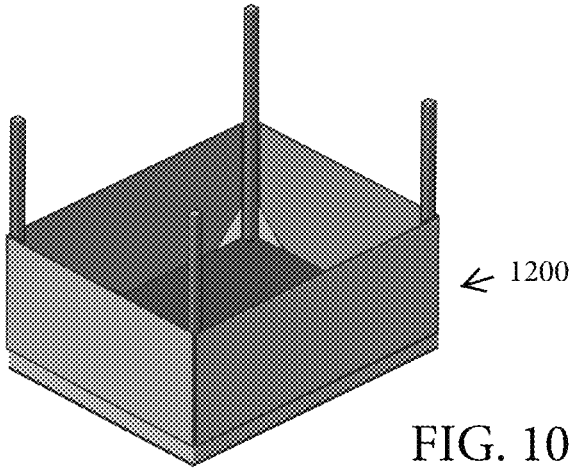
FIG. 10 is a perspective view of the base 1200 with the front 1210, left side 1220, right side 1230, and rear 1240 walls in an upright.
Figure 11:
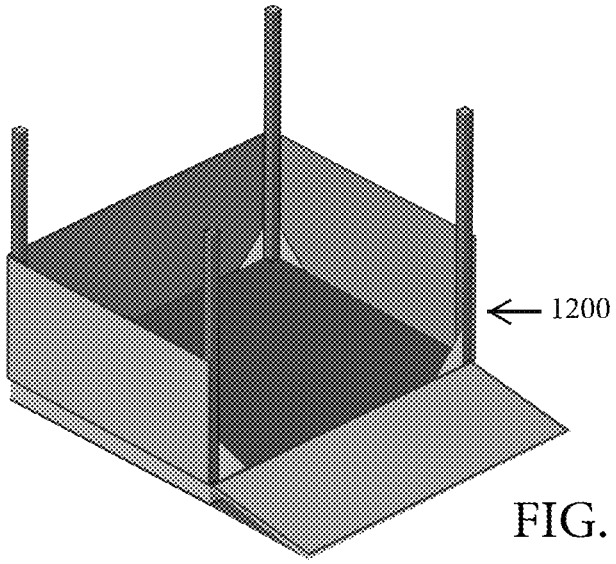
FIG. 11 is a perspective view of the base with the front 1210 wall in a lowered configuration while the left side 1220, right side 1230, and rear 1240 walls are in an upright configuration.
Figure 12:
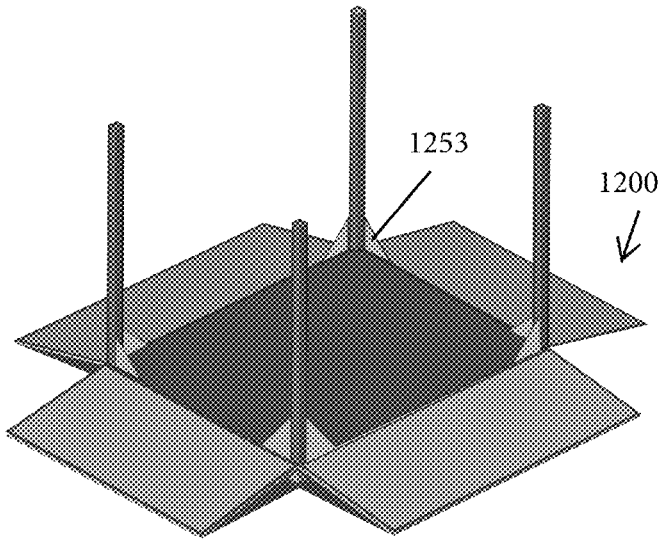
FIG. 12 is a perspective view of the base with the front 1210, left side 1220, right side 1230, and rear 1240 walls in a lowered configuration.
Figure 13:
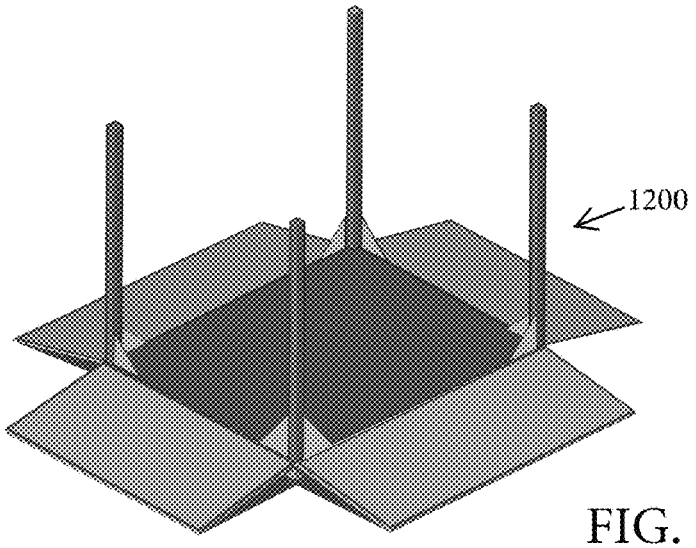
FIG. 13 is a perspective view of the base with the front 1210, left side 1220, right side 1230, and rear 1240 walls in a lowered configuration
Figure 14:
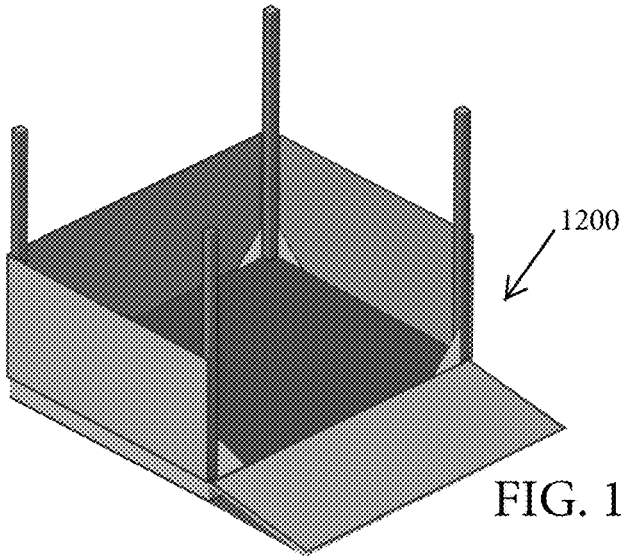
FIG. 14 is a perspective view of the base with the front 1210 wall in a lowered configuration while the left side 1220, right side 1230, and rear 1240 walls are in an upright configuration.
Figure 15:
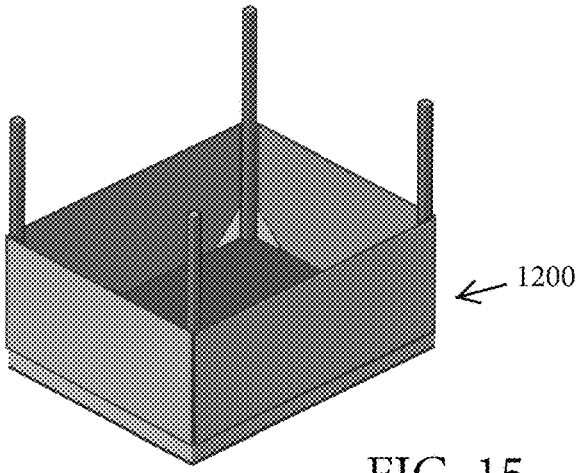
FIG. 15 is a perspective view of the base 1200 with the front 1210, left side 1220, right side 1230, and rear 1240 walls in an upright.

FIGS. 10 through 15 illustrate the use of the base 1200 as CCU (cargo caring unit) or shipping pallet. FIG. 10 is a perspective view of the base 1200 with the front 1210, left side 1220, right side 1230, and rear 1240 walls in an upright. FIG. 11 is a perspective view of the base with the front 1210 wall in a lowered configuration while the left side 1220, right side 1230, and rear 1240 walls are in an upright configuration. FIG. 12 is a perspective view of the base with the front 1210, left side 1220, right side 1230, and rear 1240 walls in a lowered configuration. With the walls lowered, cargo may be placed on the floor 1260 without obstruction and the walls 1210, 1220, 1230, and 1240 may each be used as ramp up to the floor 1160. Once the cargo (not shown) is loaded onto the floor 1260 of the base, the walls 1210, 1220, 1230, and 1240 may be closed around the cargo as shown in FIGS. 13-15. At this point, the base 1200 may operate as a pallet where a fork lift may insert tongs into the slots 1262 to lift and carry the base 1200.

Figure 19:
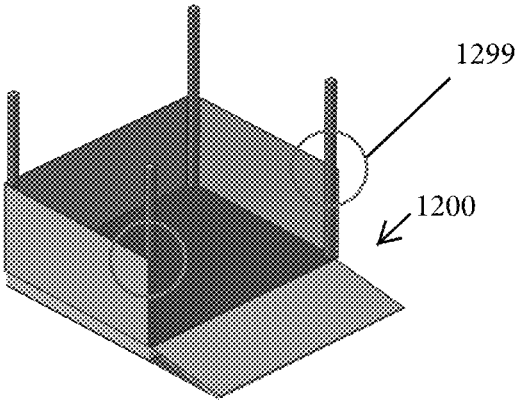
FIG. 19 is a perspective view of the shipping container with the front wall 1210 in a lowered configuration.
Figure 20:
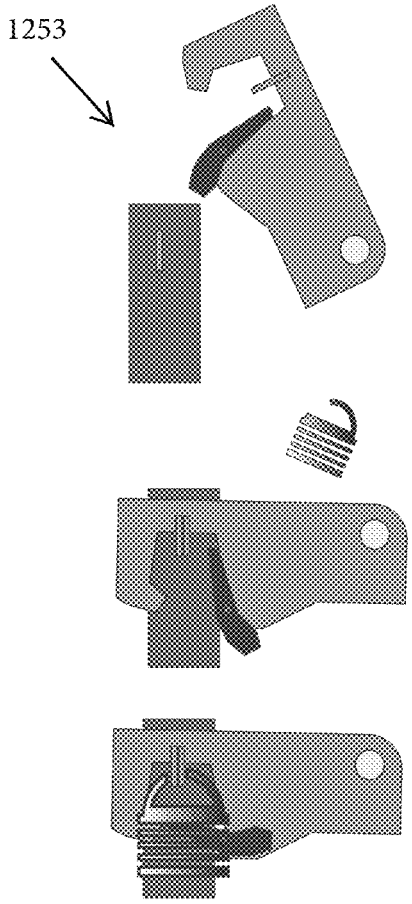
FIG. 20 is a diagram of a locking mechanism 1251 for holding the walls 1210, 1220, 1230, and 1240 in an upright configuration; and, FIG. 21 is a diagram of another locking mechanism 1252 for holding the walls 1210, 1220, 1230, and 1240 in an upright configuration.
Figure 21:
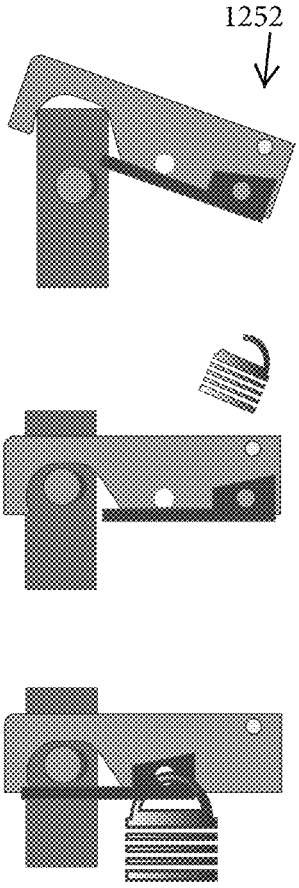

FIG. 19 is a perspective view of the shipping container with the front wall 1210 in a lowered configuration. This view exposes the lock 1299 for securing the walls 1210, 1220, 1230, and 1240 to the rails 1250 around the loaded cargo (not shown). In one embodiment, the lock may be a lever and clip that is padlocked shut as shown in FIGS. 20 and 21. FIG. 20 is a diagram of a locking mechanism 1251 for holding the walls 1210, 1220, 1230, and 1240 in an upright configuration via steps A, B and C. FIG. 21 is a diagram of another locking mechanism 1252 for holding the walls 1210, 1220, 1230, and 1240 in an upright configuration via steps A, B and C.

Figure 16:
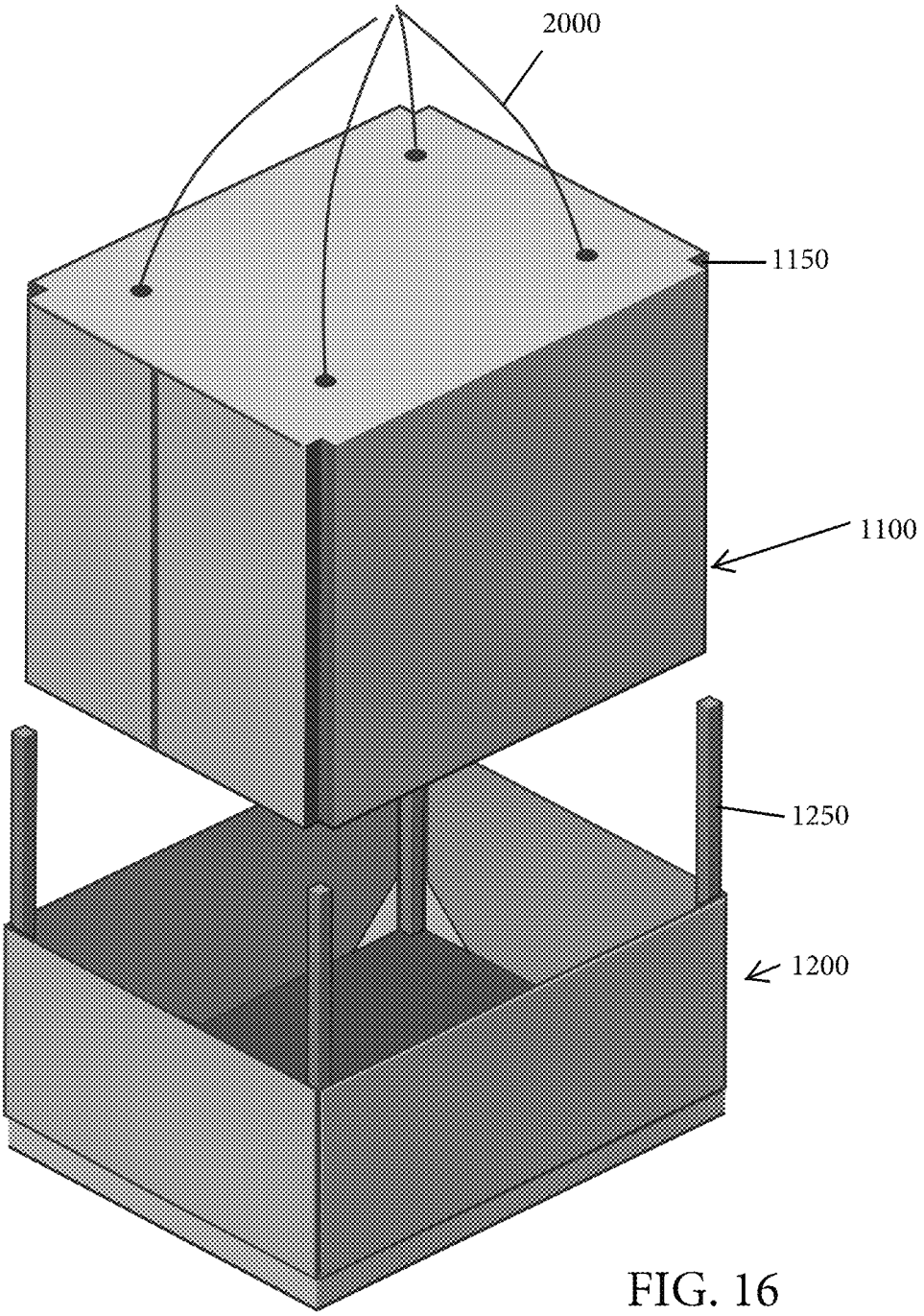
FIG. 16 is an environmental view of the shipping container 1000 wherein the bridle 2000 has been used to align the shell 1100 with the base 1200.
Figure 17:
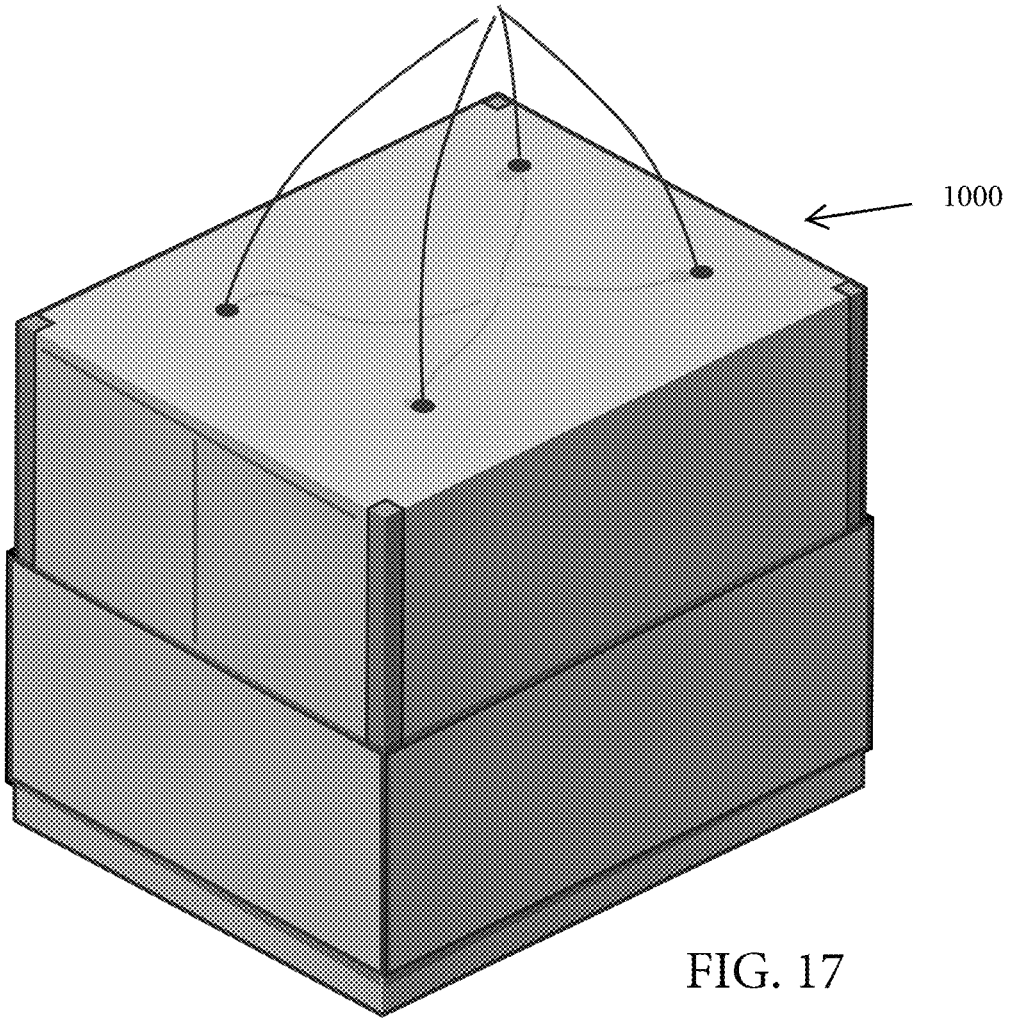
FIG. 17 is an environmental view of the shipping container 1000 wherein the bridle 2000 has been used to couple the shell 1100 to the base 1200.

Once the cargo has been placed on the floor 1260 of the base 1200 and the walls 1210, 1220, 1230, and 1240 closed around the cargo, the shell 1100 may be nested in the base 1200 to cover the cargo as shown in FIGS. 16-17. FIG. 16 is an environmental view of the shipping container 1000 wherein the bridle 2000 has been used to align the shell 1100 with the base 1200. FIG. 17 is an environmental view of the shipping container 1000 wherein the bridle 2000 has been used to couple the shell 1100 to the base 1200 via sliding the rails 1250 into the rail tracks 1150.

Figure 18:
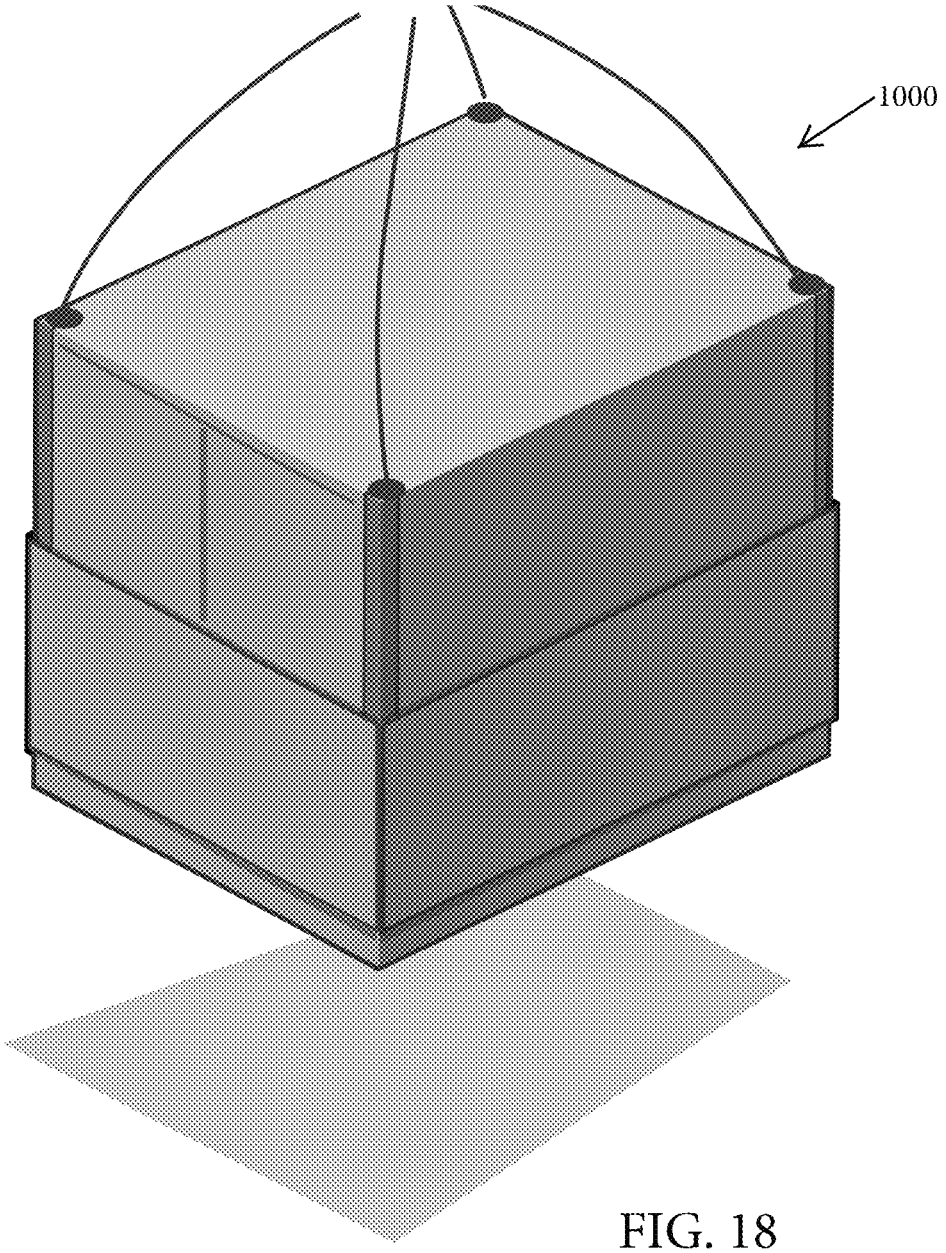
FIG. 18 is an environmental view of the shipping container 1000 wherein a bridle has been provided to the rails 1250 of the base1200 so that the shipping container 1000 can be lifted and transported.

FIG. 18 is an environmental view of the shipping container 1000 wherein a bridle has been provided to the rails 1250 of the base 1200 so that the shipping container 1000 can be lifted and transported. On one embodiment the lift uses a bridle 2000 provided to the ends of the rails 1250 of the base 1200. As shown, the bridle 2000 may comprise wire slings attached to pad eyes set into the rails 1250. In one embodiment, the bridle 200 has 4-part shackles. The base could also be equipped with forklift slots 1262 through the drip pan 1261 for lifting the container 1000 if a crane or other like machinery is not available.

It will be equipped with a built-in pollution pan containment area (optional) for spill hazards that may accrue during transport. The removable shell will also be equipped with a clamp down feature that holds the shell in place for transporting cargo from one place to another. Container will also have the standard water tight door design in front for access like a traditional container if needed.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

PAPER "SEQUENCE LISTING"

Not applicable.

I claim:

1. A shipping container 1000 comprising a shell 1100 and a base 1200 wherein:

the shell 1100 is defined by a door 1110, a roof 1160, a left side wall 1120, a right side wall 1130, a rear wall 1140 and a rail track 1150 that is disposed beneath the roof 1160 and between the door 1110 and the left side wall 1120;

the base1200 is defined by a floor 1260, a front wall 1210, a left side wall 1220, a right side wall 1230, a rear wall 1240, and a rail 1250;

a first configuration of the shipping container 1000 is defined by the shell 1100 being coupled to the base due to an association of the rail 1250 of the base 1200 with the rail track 1150 of the shell 1100 so that the shell 1100 is disposed over the floor 1260 of the base 1200 while each of the front wall 1210, left side wall 1220, right side wall 1230, and rear wall 1240 are upright relative to the floor 1260; and, a second configuration of the shipping container 1000 is defined by the shell 1100 being separated from the base 1200 via removal of the rail 1250 from the rail track 1150 and each of the front wall 1210, left side wall 1220, right side wall 1230, and rear wall 1240 being situated as a ramp from the ground up to the floor 1260.

2. The shipping container of claim 1 wherein the shell 1100 is equipped with a forklift slot.

3. The shipping container of claim 2 wherein the base 1200 includes a drip pan.

4. The shipping container of claim 3 wherein the base 1200 is a shipping pallet.

5. The shipping container of claim 3 wherein the base 1200 is a cargo carrying unit.

6. The shipping container of claim 5 wherein the rail 1250 of the base 1200 are supported by a chamfer.

* * * * *